United States Patent [19]

Saylor

[11] 4,423,538

[45] Jan. 3, 1984

[54] WIRE CONNECTION

[76] Inventor: Millard P. Saylor, 1125 W. Greenbrier Ct., Arlington Heights, Ill. 60004

[21] Appl. No.: 404,273

[22] Filed: Aug. 2, 1982

[51] Int. Cl.[3] ..... B65D 63/04

[52] U.S. Cl. ..... 24/27; 24/29

[58] Field of Search ..... 24/27, 28, 29

[56] References Cited

U.S. PATENT DOCUMENTS

| | | | |
|---|---|---|---|
| 266,587 | 10/1882 | Eastburn | 24/29 |
| 471,628 | 3/1892 | Tully | 24/27 |
| 499,809 | 6/1893 | Tully | 24/27 |
| 512,047 | 1/1894 | Moore | 24/27 |
| 539,103 | 5/1899 | Van Arsdale | 24/27 |
| 1,042,100 | 10/1912 | Flora | 24/29 |
| 3,949,450 | 4/1976 | Bailey | 24/27 |

*Primary Examiner*—Paul J. Hirsch

*Attorney, Agent, or Firm*—Edward D. Gilhooly

[57] ABSTRACT

A wire connection for two end portions of a wire including a closed loop at the first end portion of the wire and a projecting portion at the second end portion. The closed loop is inserted to a point to enable the projecting portion to extend through the closed loop. The projecting portion is deformed under loading into a configuration providing enhanced strength characteristics.

4 Claims, 7 Drawing Figures

WIRE CONNECTION

BACKGROUND OF THE INVENTION

This invention relates in general to wire connections, and, in particular, to an improved wire connection to connect the ends of an elongated wire member.

More specifically, but without restriction to the particular use which is shown and described, this invention relates to a wire connection for securing the ends of an elongated member, such as bale wire and the like, employed to wrap bales of material for transport and storage. The bale wire connection of the invention includes interconnecting members, which may be interlocked to form a strong coupling of the ends of the bale wire used in securing bulk material.

It is common practice to wrap a large package or bundle of material, generally referred to as a bale, for transport and handling by means of a plurality of elongated straps, metal wires and the like extended around the material in a continuous loop. Such baling members thus retain the material in its baled form to enable it to satisfactorily be transported and stored during various stages from its raw form to its final utilization by a textile mill and the like. Many types of material generally are shipped and stored in bales, such as man-made substances in the form of waste paper, wool, man-made fiber staple, cotton, fiberglass and the like.

The use of metallic wire is one of the preferred techniques for securing bales of such material for transport. Bale wire is particularly suitable for use in the securement of bales of cottom that are transported from the gin, where the raw cotton is separated, to the warehouse, where the cotton is stored and later sold for use in textile mills and the like. At the cotton gin, the raw fiber cotton is separated from the remaining plant material and is pressed by a press machine into a bale having a selected density and size. In general, seven different sizes of bales for cotton are accepted for shipment in the United States with varying dimensions and density per cubic foot. The density of the cotton bale compressed at the gin mill may range from a low density bale, requiring six bale wires, to a high 28 pound density bundle, requiring eight wires for adequate securement.

In use of bale wire for securing cotton bales of the type described, it is standard practice in the industry to apply the tie to the bale at the gin, while the bale is still under compression. The wire is wrapped or looped around the bale, and its ends are conventionally secured together by a square knot joint or connection, a descriptive term derived from the physical configuration of the wire at the joint. Bale wire is normally wrapped around the bale while the bundle is under compression, and the square knot is coupled by hand, Upon release of the compression applied by the gin press to the bale, the wire tie is subjected to a considerable loading, such that the square knot configuration of the joint is pulled into a smaller compressed form.

Generally, the cotton bale is then transported from the ginner to the warehouseman, whom accepts delivery of the cotton and compresses the package to a greater density for delivery to the user. Upon receipt of the shipment, the warehouseman may employ a machine, known as a "Dinky Press", that applied a compressive load to the bale of cotton received from the ginner for removing the wire ties. After removal of the ties, the bale is further processed by compacting to form a more dense bundle or package, for better efficiency in shipment. Then new bale wire is applied, and the material is shipped to the user.

The major drawback to the conventional square knot connection lies in the inherent weakness of the tie. A square knot connection is subject to failure at a loading considerably less than the force required to fracture the wire itself. Because of its inadequate strength, a square knot connection must disadvantageously be situated at the top of the bale, where the wire is subjected to the smallest load when secured on a compressed bale. It is far more convenient to position the connection at the side of the bale where access for attachment and removal is improved in comparision to the top of the bale. Accordingly, prior art techniques for securing bales have failed to provide an effective and inexpensive connection, capable of sustaining approximately equal loads as the wire itself.

SUMMARY OF THE INVENTION

It is, therefore, an object of this invention to provide an improved connection for the ends of wire and the like.

Another object of this invention is to provide a stronger bale wire tie.

A further object of this invention is to provide a bale wire tie having interconnecting end portions capable of being readily hooked into a connected relationship.

A still further object of this invention is to provide an improved wire tie meeting or exceeding all applicable government regulations and facilitating engagement and disengagement.

These and other objects are attained in accordance with the present invention wherein there is provided a wire connection or tie for use as a means to join the ends of elongated bale wire employed to secure bale material, such as cotton, waste paper, wool, man-made fiber staple, fiberglass and the like. The wire connection or ties of the invention includes a hook-like means at one wire end which engages a loop provided at the opposite end. Under loading the formed ends deformed into an interlocking bond to secure the bale wire and form an extremely strong connection demonstrating strength characteristics of at least 95% of the tensile strength of the wire itself. The wire tie herein disclosed possesses significantly improved strength characteristics over the typical square knot connection of the prior art and other known ties. The unique design of the connection of the invention allows the tie to be hooked and unhooked with ease to enable even female labor, as well as male labor, to perform such tasks without difficulty. The formed ends of the tie of the application are readily manufactured to reduce costs.

The improved strength demonstrated by the wire connection herein disclosed permits its positioning at the side of the bale, where the highest stress points applied to the wire are normally encountered. Such advantageous positioning is in contrast to the usual requirement of the square-knot-type connection and similar designs being situated at the top of the bale. Accordingly, the wire connection of the invention provides means for effectively attaching the ends of elongated wire members to form a continuous loop, such as used in bailing applications, having strength characteristics at the joint which exceed government specifications governing the packaging of cotton bales as promulgated by the Commodity Credit Corporation.

DESCRIPTION OF THE DRAWINGS

Further objects of the invention together with additional features contributing thereto and advantages accuring therefrom will be apparent from the following description of a preferred embodiment of the invention, which is shown in the accompanying drawings, with like reference numerals indicating corresponding parts throughout wherein.

DESCRIPTION OF A PREFERRED EMBODIMENT

Figure 1:
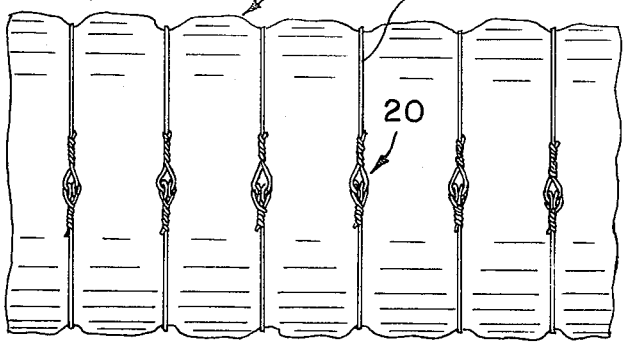
FIG. 1 is a front schematic view of a bale of material being secured by wire employing the wire connection or tie of the invention.

Referring now to FIG. 1, there is illustrated a bale 10 of material, such as cotton and the like, being secured or tied by a plurality of wires 12, each coupled by the improved wire connection of the invention, generally designated by the reference numeral 20. Conventionally, a plurality of wire ties 12 are employed, such as, in connection with the baling of cotton, six to eight wire ties dependent on the density of the bale material, as established by the Commodity Credit Corporation. The bailing wire or tie 12 is in the form of steel wire or similar material that forms a continuous loop about the bale 10, after the ends of the wire are interconnected by the wire connection 20. Generally, the bale wire 12 is applied to the bale 10 while the material is being compressed by typical press, such that upon removal from the machine, each of the wires 12 is subjected to a condsiderable loading transmitted by the compressed state of the bale 10 as maintained by the wires 12. As shown in FIG. 1, the wire connection 20 of the invention may be effectively positioned along the sides of the bale 10, where the greatest load on each wire may be encountered.

Figure 2:
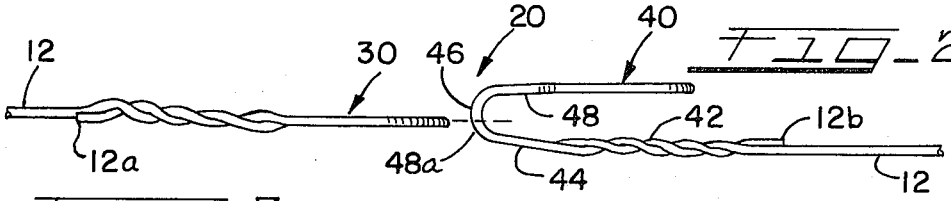
FIG. 2 is a partial side view of one of the bale wires of FIG. 1 showing the wire connection of the invention in an unhooked configuration.
Figure 3:
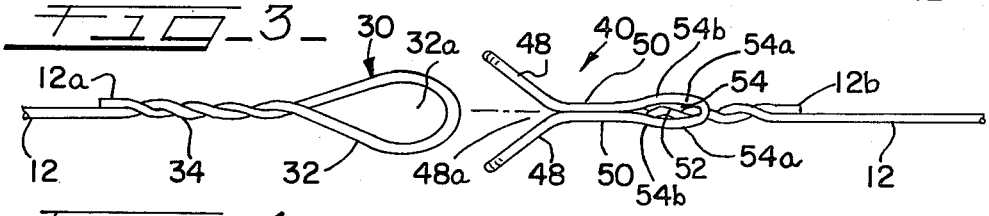
FIG. 3 is a top schematic view of the wire connection shown in FIG. 2.
Figure 5:
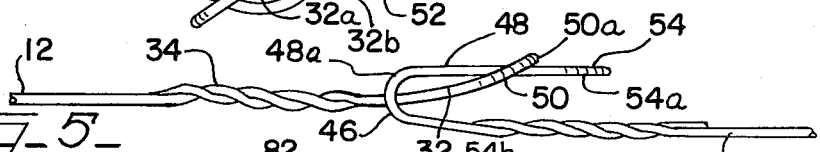
FIG. 5 is a side schematic view of the configuration of the wire connection shown in FIG. 4.

The first end portion 30 of the wire connection of the invention is formed in the configuration best shown in FIGS. 2 and 3. A continuous loop 32 having an open center **32*a* is created at the end of the wire 12 by folding back the wire end 12*a* to a point adjacent another portion of the wire body 12. The wire adjacent end 12*a* is then twisted together with the adjacent portion of wire 12 to form a plurality of twists 34 which permanently restrain loop 30 into the form shown. Although the plane of the continuous loop 32 of the wire end 30 is shown generally as being disposed in the same or parellel plane as the twisted portion 34, it is within the scope of the invention to bend the loop 32 into other angular relationships therewith as illustrated in FIG. 5**, if desirable in forming the wire connection of the invention.

The opposite end portion 40 of the wire 12, which is arranged to be adjacent end 30 when wire 12 is disposed about bale 10, includes a bent back end configuration to form an approximate U-shaped construction and projecting member at the end of the wire (FIG. 2). The bent back portion 40 is formed by a section of the wire 12 adjacent to the end **12*b* thereof that is bent back with respect to an adjacent portion of the wire 12. The section of the wire immediately adjacent to the wire free end 12*b* is twisted with the body of the wire 12 to form a twisted section 42 having four or more twists of the same general configuration as twisted portion 34 at the first end 30. The configuration of end portion 40 is created by two end strands of twisted section 42 diverging outwardly at section 44 in a V-shape (FIG. 3) with an approximate upward slight slope, viewing FIG. 2**, to form a pair of legs.

The legs 44 are each bent back by a curved section 46 to form a modified U-shape with converging legs 48 lying in an upper V-like relationship above legs 44. The V-shape forms a loop receiving opening **48*a* through which loop 30 may be inserted and directed between projection 40 and V-segments 44 and twists 42** as the wire connection is being made.

The upper legs 48 converge together and continue in a side-by-side relationship as a pair of wire segments 50, which extend parallel to the axis of the wire 12. The segments extend backward in an approximate parallel relationship to twisted section 42 and terminate as a free end in the form of a small elongated continuous loop 52 forming an opening 54 to widen the projecting member at periphery **54*a* to provide bearing areas 54*b*. It should be noted that the loop 52 is also disposed in an approximate parallel position above the twisted portion 42** of the wire.

Figure 4:
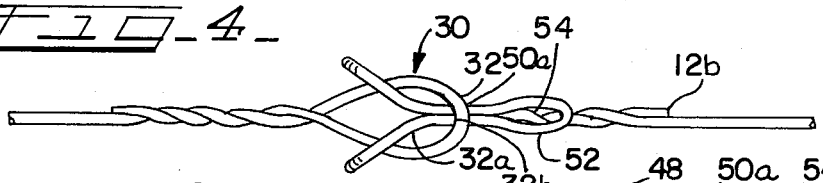
FIG. 4 is a top schematic view of the bale wire connection of FIG. 2 shown in an engaged or hooked configuration prior to being subjected to a tensile load in securing the bale.

In FIGS. 4 and 5, the initial connection of the hook end portion 40 with the loop 32 of the first wire end portion 30 to connect the two wire ends prior to be subjected to a normal tensile force to retain a bale is illustrated. The configuration of the formed end portions 30 and 40 shown in FIGS. 4 and 5 corresponds to their relative shape prior to the bale being released by the press. As stated previously, the loop 32 is inserted through opening **48*a* beneath projection 40 and is pushed a sufficient distance to enable the loop 32 to clear the end 54 of the projection 40 so that end portion 32*b* of loop 32 is above projection 40. The opposite wire portions are then pulled apart until the loop 32 is arranged to be approximately positioned as shown in FIGS. 4 and 5 with portion 32*b* contacting an area 50*a* of segments 50, and the loop 32 extending through opening 48*a***.

Figure 6:
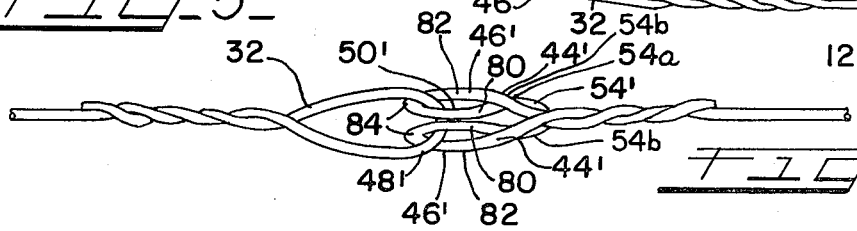
FIG. 6 is a top schematic view of the wire connection of FIG. 4 after being deformed upon being subjected to a tensile load in securing the bale.
Figure 7:
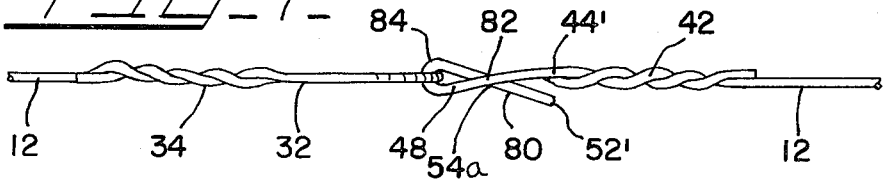
FIG. 7 is a side schematic view showing the wire connection in the condition shown in FIG. 6.

In FIGS. 5 and 6, the connection 20 of the invention is shown in its distorted, locked configuration after a bale is removed from its form by the press and the like and is retained solely by bale wires 12 as in FIG. 1. After release, the bale 10 remains compressed to a lesser degree by the bale wires and to subject the wires to tensile force. Because of the improved arrangement of the connection of the invention, its form is distorted and pulled together into a strong coupling having a strength approximately equal to the strength of the wire itself under a tensile loading. The corresponding sections of the portion 40 of FIGS. 2 to 4 corresponding to the original, undistorted shape are approximately illustrated in their generally distorted form by the same reference numeral with a prime symbol in FIGS. 5 and 6.

As is shown in FIGS. 5 and 6, the loop 52 is pulled under loading through the V-shaped segments 44', and the initial curved portion 46 is distorted and flattened as it is pulled into a compressed or distorted form. The result is that loop 52' is disposed at a position within stretched sections 44', 44' and opposed to its original position substantially parallel to the wire as in FIG. 2. The tightening of the sections 44' and 44' against the loop 52' insures that a stable and stronge link is created, since this loop cannot be pulled through the compressed configuration of the connection as shown in FIG. 6. In effect, the diverging portions 48, 44 and 44 are induced to close inward respectively toward each other, while the U-shaped portions 46 undergo a straightening action. This results in a pair of wire sections 80 extending through a pair of portions 82 of end portion 40 in a crossing pattern with a loop 84 of end portion 40 being disposed around a section of closed loop 32. The original the bearing areas 52 of loop 52 are wedged against the distorted outer portions 82, and a crossing relationship of the end portion 80 with portion 82 is established.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wire connection for joining two ends of a wire member comprising:

a first end portion of the wire member adjacent one end thereof being formed in a closed loop, a second end portion of the wire adjacent the other of the ends of the wire member being bent back over an adjacent portion of the wire member to form a projection lying in spaced relationshp thereto, said projection having a free end spaced from said adjacent portion, the end section of said free end portion having a widened configuration relative to the adjacent portion of said free end portion, said widened configuration forming at least one bearing area, said second end portion further forming a wire receiving opening for permitting insertion of said closed loop projection and said adjacent wire portion, said closed loop being arranged to be inserted in a first direction through said opening to a position where said projection passes said closed loop upon withdrawal of said first end portion in a direction opposite to said first direction, said second portion acting to be distorted in a secure connection with said closed loop upon application of a selected tensile force on the wire member, said at least one bearing area being wedged against another portion of said second end portion after distortion, and said second end portion deforms under application of the tensile force to cause one section thereof to extend in crossing relationship with yet another portion of said second end portion.

2. The wire connection according to claim 1 wherein said second end portion includes a pair of wire sections bent back in an approximate U-shape for forming said projection, said end section being a second closed loop forming a pair of said bearing areas on its outer periphery.

3. The wire connection according to claim 2 wherein said wire sections diverge outward relative to said wire member for forming said opening.

4. A wire connection comprising:

a first loop formed on an end portion of a wire, a second loop formed on the opposite end portion of the wire, said second loop forming the free end of a bent back portion of the wire to create a projecting member, said second loop being a widened area relative to the remainder of said bent back portion and forming a pair of bearing surfaces, said bent back portion of said wire having a pair of wire segments spaced apart to allow insertion of said first loop there between to a position where said free end is inserted through said first loop, said opposite end portion being subject to deformation upon application of a force to the wire to attain a connection after said insertion, said bearing surfaces of said projecting member wedge against spaced areas of said opposite end portion upon deformation thereof, and a portion of said projecting member is bent around a section of said first loop upon deformation of said first portion.

* * * * *